United States Patent [19]

Bauch

[11] Patent Number: 4,486,990

[45] Date of Patent: Dec. 11, 1984

[54] REMOVABLE WINDOW INSULATION SYSTEM

[76] Inventor: Tamil D. Bauch, Box 394B R.F.D. 1, Kingston, N.Y. 12401

[21] Appl. No.: 370,525

[22] Filed: Apr. 21, 1982

[51] Int. Cl.[3] ..... E06B 7/16; E04B 1/62

[52] U.S. Cl. ..... 52/202; 52/397; 52/309.4; 49/488; 49/490; 49/61

[58] Field of Search ..... 52/202, 397, 403, 408, 52/406, 309.4; 49/488, 490, 475, 61

[56] References Cited

U.S. PATENT DOCUMENTS

| | | | |
|---|---|---|---|
| 2,191,500 | 2/1940 | Rosling | 52/202 |
| 2,340,469 | 2/1944 | Hall | 52/403 |
| 3,141,206 | 7/1964 | Stephens | 52/406 |
| 3,641,707 | 2/1972 | Kellos | 49/488 |
| 3,998,015 | 12/1976 | Scott et al. | 52/309.4 |
| 4,126,966 | 11/1978 | Lobell | 49/475 |
| 4,255,907 | 3/1981 | Lightell | 52/202 |
| 4,272,934 | 6/1981 | Cowden et al. | 52/202 |
| 4,416,096 | 11/1983 | Schuster et al. | 52/202 |

*Primary Examiner*—John E. Murtagh
*Assistant Examiner*—Michael Safavi
*Attorney, Agent, or Firm*—Natter & Natter

[57] ABSTRACT

A window insulation system comprises a panel formed of a rigid foam insulation board dimensioned less than the interior casing dimensions of a window. To the periphery of the board, a highly compressible foam strip is secured by a contact type adhesive. The foam strip comprises a laminate of foam webs having an intermediate vapor impermeable membrane of aluminized film. The membrane lies in a plane parallel to the plane of the interior face of the board. A flexible layer completely covers the foam strip and extends over opposite faces of the board to reduce tensive stress at the joint between the strip and the board during insertion or removal of the panel from the casing. The flexible layer may comprise a decorative fabric which completely covers the interior face of the board.

16 Claims, 10 Drawing Figures

FIG. 1
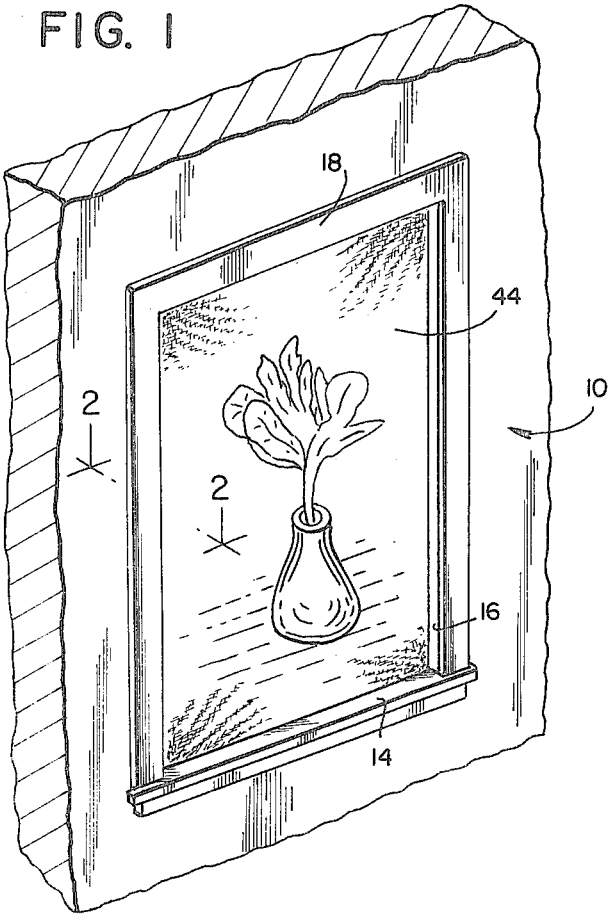
FIG. 2
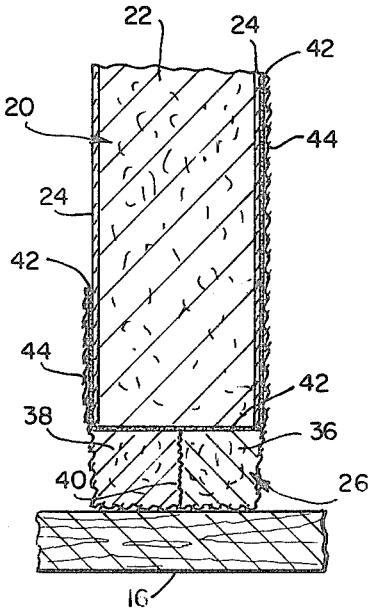
FIG. 3
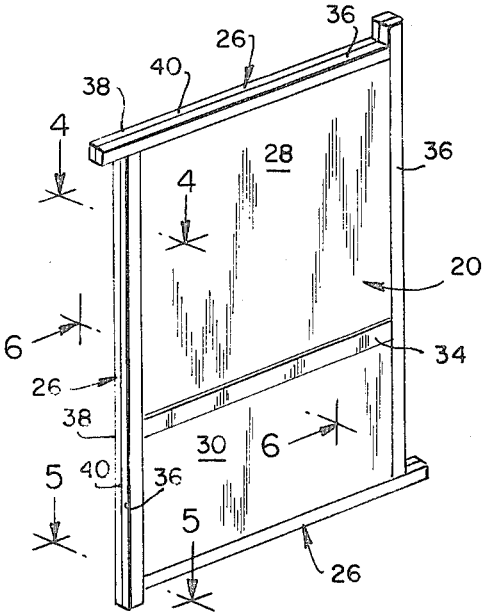
FIG. 10
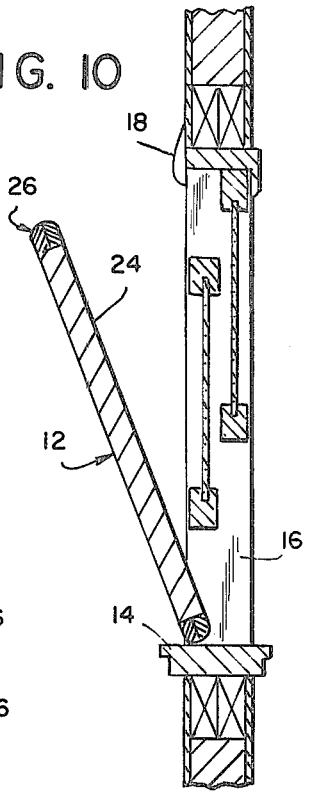
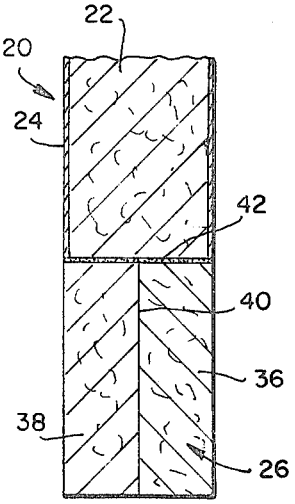
FIG. 4

FIG. 5
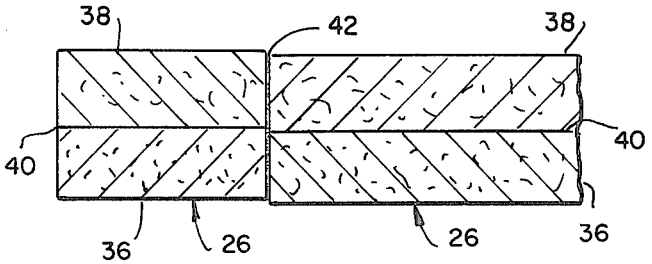
FIG. 6
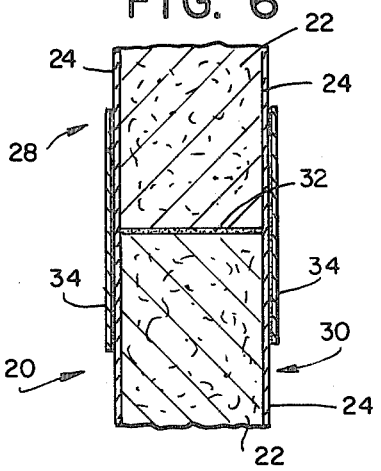
FIG. 8
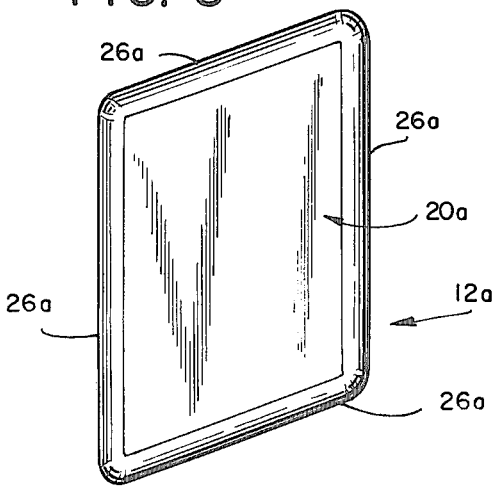
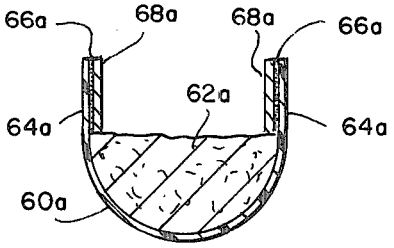
FIG. 7
FIG. 9
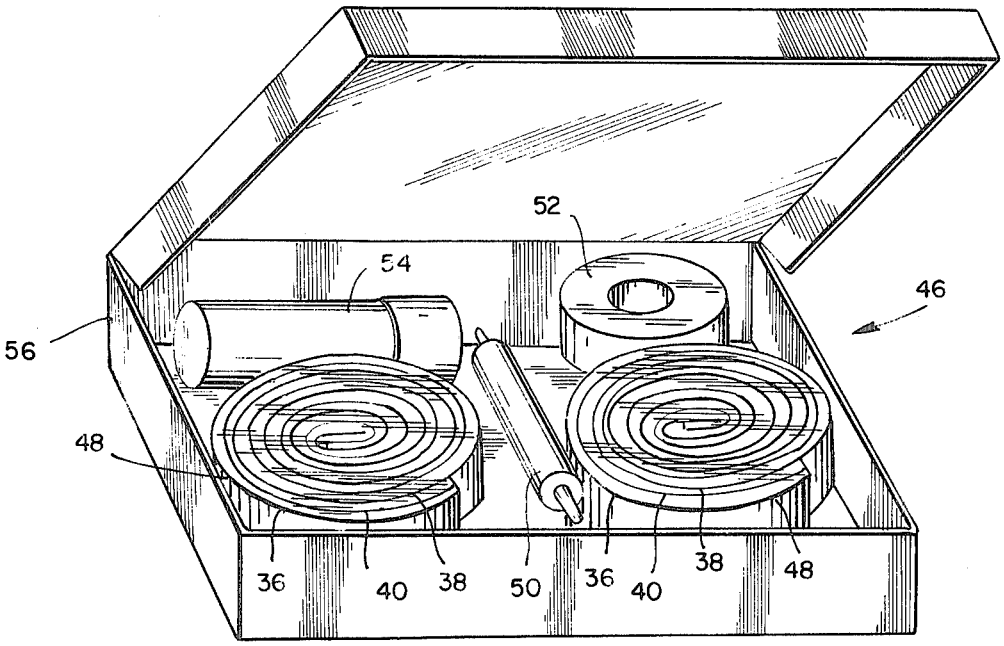

REMOVABLE WINDOW INSULATION SYSTEM

TECHNICAL FIELD

The inventive improvement relates generally to thermal insulation for windows and in particular to insulation panel systems which are simple to construct and easy to insert into and remove from a window casing.

BACKGROUND ART

Ever increasing fuel costs have emphasized the need for minimizing heat loss in structures such as dwellings, industrial buildings and offices. Although heat loss has been reduced through the installation of fixed insulation in walls, ceilings and the like without adversely affecting the functionality of the building, a major source of heat loss in buildings comprised windows which presented significant problems in conjunction with heat loss. Some insulation measures heretofore proposed included the permanent or semipermanent sealing of windows during seasons of adverse weather conditions which precluded easy operability for ventilation purposes. Other insulation approaches further encompassed blocking such windows with insulation materials thereby precluding their use for illumination, observation and as a portal for solar radiant heat.

The prior employment of double and/or triple glazing over existing lights was accomplished only with costly installation and equipment expenditures and did not preclude energy losses through the window casings.

One approach toward low cost window insulation was illustrated in *Movable Insulation* by William K. Langdon. Such approach involved the use of pop-in shutters comprising insulating panels secured to the window casing. Langdon described a friction fit pop-in shutter which required a wooden peripheral edge framing glued to a foam board to prevent binding of the board. Unfortunately, the construction technique mandated precise measurement of the window casing and low tolerances in cutting an insulation board to size. For example, 3 mm. ($\frac{1}{8}$ inch) was allotted for compression of a 5 mm. (3/16 inch) peripheral gasket. An undercut of 3 mm. ($\frac{1}{8}$ inch) prevented a peripheral seal from forming around a panel. Board cutting became even more difficult when the window casings were not square.

Due to the low tolerances required for constructing such shutters, average do-it-yourself homeowners encountered significant difficulties. Tolerance levels were not within the ambit of these individuals, insulation board material was wasted, and attempts at construction resulted in frustration. Further, because of the tight fit, handles or clips were necessary for insertion or removal.

DISCLOSURE OF THE INVENTION

In compendium, the present invention comprises a window insulation panel system of easily removable rigid foam insulating boards such as foil faced foam isocyanurate sheathing. A compressible border formed of a foam strip is secured to the periphery of the board. The foam strip includes an intermediate impermeable membrane which provides a vapor barrier.

The foam strip is of a width and composition allowing a significant compression range such that a wide tolerance in board dimensions is provided.

A fabric or other layer of flexible material extends over the foam strip to opposite faces of the panel to reduce tensive stresses at the joint between the strip and the board as well as reduce ultraviolet degradation.

In an alternate embodiment, the flexible layer comprises a vapor impermeable tape having a foam strip adhered along its longitudinal axis. A pressure sensitive adhesive layer is provided along the interior faces of the tape for adhesion against opposite faces of the board.

To facilitate economical fabrication, a kit may be supplied for do-it-yourself construction with the user purchasing the insulation board locally. The kit includes lengths of compressible foam strip and contact type adhesive for securing both the foam strip and a decorative fabric to the panel. In addition, the kit may include a mastic type adhesive for splicing board sections together and aluminum foil tape for rigidifying a splice.

From the foregoing summary, it will be appreciated that a principal feature of the present invention is to provide a window insulating system of the general character described which is not subject to the aforementioned disadvantages of the background art.

A further feature of the present invention is to provide a window insulation system of the general character described which is easy to construct and provides significant latitude in dimensional tolerances.

Another aspect of the present invention is the provision for a window insulation system of the general character described in kit form which is well suited for do-it-yourself construction by unskilled individuals.

Another feature of the present invention is to provide a window insulation system which facilitates ventilation and diffused sunlight illumination.

An additional aspect of the present invention is to provide a window insulation system of the general character described which is simple to use, easy to mount within a window casing to preclude drafts and heat loss, yet simple to remove to access the window for illumination, ventilation or emergency exit.

An additional aspect of the present invention is to provide a window insulation system of the general character described which effectively seals a window casing against vapor penetration.

An additional feature of the present invention is the provision for a window insulation system of the general character described which is simple to construct and may be assembled in but a modicum of time.

Other features and aspects of the present invention in part will be obvious and in part will be pointed out hereinafter.

With these ends in view, the invention finds embodiment in various combinations of elements and arrangements of parts by which the said features and certain other features are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown some of the various possible exemplary embodiments of the invention:

FIG. 1 is a fragmentary perspective illustration of an interior face of a dwelling wall which includes a window and showing a window panel constructed in accordance with and embodying the present invention installed within and sealing a window casing;

FIG. 2 is an enlarged fragmentary sectional view through the window casing and the panel, the same being taken substantially along a plane 2—2 of FIG. 1 and illustrating an edge seal formed between a jamb of the casing and a compressible strip which is secured to an insulation board of the panel;

FIG. 3 is a perspective illustration during construction of a typical panel after the compressible strip has been bonded to the periphery of the board and prior to the step of trimming the strip;

FIG. 4 is an enlarged fragmentary sectional view through the insulation board and the compressible strip, the same being taken substantially along a plane 4—4 of FIG. 3 and illustrating the panel prior to covering the foam strip and board with a flexible layer of fabric;

FIG. 5 is an enlarged fragmentary sectional view through the compressible strip, the same being taken substantially along the plane 5—5 of FIG. 3 and illustrating the manner in which a vapor barrier is substantially maintained although sections of the strip have not been registered at a butt joint;

FIG. 6 is a further enlarged fragmentary sectional view through the board, the same being taken substantially along the plane 6—6 of FIG. 3 and illustrating a typical board splice;

FIG. 7 is a transverse sectional view through a compressible strip constructed in accordance with an alternate embodiment of the invention wherein a compressible foam is secured to a vapor impermeable tape;

FIG. 8 is a perspective illustration of a panel constructed in accordance with the alternate embodiment wherein the tape is secured about the periphery of a board;

FIG. 9 is a perspective illustration of a kit for constructing panels in accordance with the present invention; and FIG. 10 is a sectional view through the panel and casing with the panel in a canted position for ventilation and illumination.

BEST MODE FOR CARRYING OUT THE INVENTION

Referring now in detail to the drawings, the reference numeral 10 denotes generally a window insulation system constructed in accordance with and embodying the present invention. The system 10 comprises an insulating panel 12 frictionally received within the interior dimensions of a window casing. The casing may comprise a sill 14, a pair of side jambs 16, a lintel (not shown) and a molding 18.

The panel 12 is dimensioned to be slipped into the window casing when it is desired to provide additional insulation against heat loss, e.g. during the night. To permit sunlight to enter during daylight hours and for accessing the window for interior ventilation, the panel 12 may be partly or completely removed.

The panel 12 includes a foam insulation board 20 which may be suitably formed from rigid foam isocyanurate sheathing. Such sheathing is available at building supply facilities. Preferably, the sheathing is foil faced on each side for reducing radiation heat loss and to provide a fire barrier. Alternate sheathing material may comprise phenolic foam or any other suitable rigid insulation material.

Pursuant to the present invention, the sheathing is cut to form the board 20 which is dimensioned to be received within the window casing. As illustrated in FIGS. 2 and 4, the board 20 includes a rigid foam core 22 and layers of foil 24 adhered to each planar face. The board 20 is sized less than the interior window casing dimensions and thereafter a compressible strip 26 is secured along its periphery.

For the purpose of conserving sheathing material, a board 20 may be constructed of two or more sheathing segments which have been spliced together as illustrated in FIG. 3. From the sectional view of FIG. 6, it will be observed that splicing may be accomplished by joining an edge of an upper sheathing segment 28 against an edge of a lower sheathing segment 30. The edges are preferably butted together with a layer of suitable adhesive 32 such as a mastic adhesive. To strengthen the splice and maintain both insulation and fire retardent characteristics of the sheathing, a layer of tape such as foil duct tape 34 is secured to opposite faces of each board section adjacent the splice joint.

The compressible strip 26 comprises a laminate of two webs 36, 38, each being formed of a suitable flexible foam such as open cell polyurethane, polyvinyl chloride or synthetic rubber. Between each of the webs 36, 38 a vapor impermeable membrane 40 is positioned. The membrane 40 may comprise an aluminized polyester film such as a Mylar film or other aluminized polymeric film. The membrane 40 is suitably secured between the webs 36, 38 by conventional techniques such as heat or adhesive bonding. It should be appreciated that the membrane 40 functions as a stiffening spine yet does not prevent compression of the strip 26. With the membrane 40 bonded between the webs 36, 38, the typical crinkling noise which accompanies movement of aluminized film is reduced.

In accordance with the invention, the board 20 is cut to a size slightly less than the interior casing dimensions in both the length and width. For example, the board 20 is cut to a size 3 inches less in the width and height than the mating window casing. To the periphery of the board 20, the compressible strip 26 is secured, with the plane of the membrane 40 parallel to the board faces. Lengths of the compressible strip 26 are cut slightly larger than the corresponding edges of the board 20 and are secured edgewise against the board 20 with a suitable adhesive coating as shown in FIG. 3.

An adhesive which has been found to be particularly advantageous for such purposes is an aerosol spray contact type adhesive such as that sold by the 3M Company as Number 74. The edges of the board 20 and the compressible strip 26 are sprayed with such adhesive and the mating surfaces thereafter bonded with pressure.

It should be noted that one end of each strip is in substantial registry with an adjacent edge of the board 20 which runs perpendicular to the span of the edge to which the strip is bonded. To such end, a coating 42 of adhesive is applied for the purpose of bonding to an abutting compressible strip which extends along the adjacent perpendicular board edge, overlapping the strip end as illustrated in FIG. 5. Thereafter, any additional projecting length of each strip 26 which extends beyond the bonded end of the adjacent strip is trimmed with a cutting implement such as a knife or scissors.

Returning again to the illustration of FIG. 5, it will be appreciated that the coating of adhesive 42 maintains continuity of the vapor barrier seal provided by the membranes 40 in the event adjacent compressible strips 26 are not in registry at a butt joint. This butt joint technique may also be employed to splice shorter lengths of compressible strips together along a single edge of the board 20 while maintaining the integrity of the vapor barrier provided by the membrane 40.

From a comparison of FIGS. 2 and 4, it will be seen that the compressible strip 26 is compressed to within a range of one-third to two-thirds its unstressed width when inserted within a window casing. If the board 20 is sized one to three inches (2.5 cm.–5.0 cm.) less than the casing dimensions, the unstressed width of each strip is approximately 1½ to 1¾ inches (3.8 cm.–4.4 cm.). Since additional compression is thus possible, one's fingers can slip behind a panel to grasp the panel for removal or insertion. In the event the board 20 is cut undersized, two lengths of compressible strips 26 may be aligned and bonded together with the adhesive layer 42 to form a double width strip.

In order to provide a pleasing aesthetic appearance to the panel 12 and preserve the bond between the interior edge of each compressible strip 26 and the peripheral edge of the board 20, a layer of decorative fabric 44 covers the interior foil face of the panel 12 and wraps about the compressible strips 26 to be beyond the adhesive joint. The fabric also protects the strip from ultraviolet degradation and mechanical damage.

The fabric layer 44 may comprise any suitable fibrous or nonfibrous material. It may be easily bonded to the surface of the panel 12 through the use of the aerosol spray contact adhesive which is applied along both the interior and exterior foil faces of the panel. To facilitate such bonding, the fabric is preferably not of open weave. As shown in FIG. 2, the fabric layer 44 preferably wraps around the exterior foil face of the panel 12. As such, the fabric layer 44 acts to reduce mechanical stresses at the joint between the compressible strip 26 and the edge of the board 20. Such stresses are normally encountered upon insertion of the panel into a window casing or removal therefrom and would otherwise tend to peel the strip 26 from the board 20.

A typical kit 46 for do-it-yourself construction of insulating panels 12 is illustrated in FIG. 9. Included in the kit 46 are coils 48 of the strips 26, a tube of mastic adhesive 50 for splicing sheathing segments, a roll of foil tape 52 for rigidifying such splices, a can of aerosol spray adhesive 54 and instructions (not shown). In an exemplary manner, the components of the kit are shown to be carried in a container 56. The user will separately purchase the sheathing.

In FIGS. 7 and 8, an alternate embodiment of the invention is illustrated. In this embodiment, like numerals are employed to designate like components as the prior embodiment, bearing the suffix "a" however. An insulating panel **12*a* is similar in construction to the insulating panel 12 described with reference to the prior embodiment but includes a compressible strip 26*a*** of modified construction.

The compressible strip **26*a* comprises a vapor impermeable plastic tape 60*a* which may be aluminized. The tape is preferably of U-shaped cross-sectional configuration as illustrated in FIG. 7 and includes a continuous layer 62*a* of compressible foam such as flexible polyurethane. The strip 26*a* may be formed by shaping the tape 60*a* and then pouring the foam into the bight area of its U-shaped configuration. The tape 60*a* includes a pair of parallel side panels 64*a* which project beyond the foam 62*a*. To the interior surfaces of each side panel 64*a*, a layer of transfer or pressure sensitive adhesive 66*a* is applied followed by a layer of release paper 68*a***.

During panel construction, after the board **20*a* is cut to size, lengths of the compressible strip 26*a* are cut. Preferably, each end of the strip 26*a* is cut at an angle and the cut ends of adjacent strips are butted together. A brushable liquid adhesive is then applied at such butt joints. It should be appreciated that such construction technique may also be employed with the strips 26** of the prior embodiment.

To secure the compressible strips **26*a* to the edges of the board 20*a*, the release paper 68*a* is removed and pressure is applied to the exterior surface of the side panels 64*a***.

The panel **12*a* may be thereafter covered with a suitable fabric in a manner identical to that described with reference to the previous embodiment, or the board 20*a* may be covered on one or two sides with paint or adhesive attached fabric before attaching the strips 26*a*** thus reducing labor and cost of materials.

In accordance with the invention, the panel 12 may be partially or completely removed from the window casing to permit the window to be opened for ventilation. During summer months, it is desirable to ventilate and illuminate interior spaces while blocking the entrance of direct sunlight. FIG. 10 illustrates a typical application for such objective. The panel 12 is shown partially removed from the window casing and canted inwardly from the header or top of the casing. The strips 26 exert sufficient pressure against the jambs 16 to frictionally retain the panel 12 in such position.

To provide ventilation, the window is first opened preferably at the bottom and the panel 12 is then slipped between the jambs 16 in an area adjacent the sill 14. The angle of inclination is variable depending upon the amounts of diffused sunlight and ventilation desired. It should be noted that the foil 24 on the exterior face of the panel 12 reflects direct sunlight thereby reducing interior space heat gain.

Pursuant to the present invention, window insulation systems may be easily constructed by unskilled persons. Exactitude of measurements and dimensions for the board are not essential. If a sheathing segment is cut too small, it can be spliced to another segment or the compressible strip may be thickened with an additional strip width or a trimmed strip. The added strip portion is bonded with the contact adhesive.

It should be noted that the aluminized membrane not only provides a continuous vapor barrier but, in addition, the aluminized reflective surface maintains a radiant thermal barrier in conjunction with the foil layers of the board.

Thus, it will be seen that there is provided a window insulation system which is well suited to meet the conditions of practical usage and which embodies the features and aspects of the present invention.

Since various possible embodiments may be made of the present invention and further changes may be made in the exemplary embodiment set forth herein, it is to be understood that all material set forth or shown in the accompanying drawings is to be interpreted as illustrative and not in a limiting sense.

Having thus described the invention, there is claimed as new and desired to be secured by Letters Patent:

1. A movable insulation system adapted for selective insertion into and removal from a window casing to provide a thermal and vapor barrier between an interior space and the window, the system comprising a panel, the panel including a frameless substantially rigid planar insulating board and a compressible strip secured along the periphery of the board, the strip including an intermediate vapor impermeable membrane, the membrane lying substantially in a plane parallel to a face of the board, the board being dimensioned less than the corresponding dimensions of the casing, the compressible strip being compressed when the panel is inserted into the casing and providing a friction fit for the panel with the membrane and the board providing a continuous vapor and thermal barrier between the interior space and the window.

2. An insulation system constructed in accordance with claim 1 wherein the panel further includes a fabric layer, the layer covering the interior face of the board, the layer overlapping the strip and being secured against the exterior face of the board whereby the panel is rendered compatible with interior decor while the compressible strip is reinforced against inadvertent dislodgement.

3. A thermal insulation system constructed in accordance with claim 1 further including a contact type bonding agent between the board and the strip.

4. A thermal insulation system constructed in accordance with claim 1 wherein the board is formed of a plurality of segments, adjacent segments being joined along common abutting edges, the board further including a layer of mastic adhesive bonding the abutting edges of adjacent segments.

5. A thermal insulation system constructed in accordance with claim 4 wherein the board includes a foil layer on each face, the board further including foil tape adhered to the foil layers of each face and overlying the common abutting edges of the adjacent segments.

6. A thermal insulation system constructed in accordance with claim 1 wherein the membrane comprises a polymeric film.

7. A thermal insulation system constructed in accordance with claim 1 wherein the strip comprises a laminate, the laminate including a pair of compressible foam webs, the membrane forming an intermediate layer.

8. A kit for assembly or do-it-yourself construction of window insulation systems from rigid insulation sheathing, the kit comprising a length of compressible strip material and adhesive, the strip material comprising a foam web and a vapor impermeable membrane, the membrane extending uninterruptedly along the length of the strip material and between the longitudinal edges thereof, the strip material being adapted for securement abutting the peripheral edges of a board formed from the insulation sheating and for being secured to the board by the adhesive, the strip material having an unstressed thickness suitable for an initial compression seal between a window frame and an insulation panel formed of the board and the strip material secured to the peripheral edges of the board, the strip material being further compressible from such initial compression sufficient to permit a user's fingers to enter between the window frame and the strip material for placement and removal of the panel whereby frequent insertion and removal from a window frame is facilitated.

9. A kit for do-it-yourself construction of window insulation systems constructed in accordance with claim 8 wherein the strip comprises a laminate formed of a pair of compressible foam webs, the membrane comprising an intermediate layer between the webs.

10. A kit for do-it-yourself construction of window insulation systems constructed in accordance with claim 9 wherein the webs are formed of open cell polyurethane.

11. A kit for do-it-yourself construction of window insulation systems constructed in accordance with claim 9 wherein the membrane comprises a polymeric film.

12. A kit for do-it-yourself construction of window insulation systems constructed in accordance with claim 8 further including a mastic adhesive and a pressure sensitive foil tape, the mastic adhesive and the foil tape being adapted for splicing sheathing segments.

13. A compressible strip for use in conjunction with a movable insulation system adapted for selective insertion into and removal from a window casing, the strip comprising an elongate vapor impermeable tape of generally U-shaped cross-sectional configuration, a compressible foam bonded to the interior surface of the tape substantially along the length thereof, the tape further including a pair of substantially parallel side panels extending beyond the compressible foam, the strip further including pressure sensitive adhesive on the interior faces of the side panels, the strip being adapted for securement around the peripheral edges of a rigid foam sheating which is dimensioned to be received within the window casing and with the side panels being secured against the faces of the sheathing by the pressure sensitive adhesive.

14. A compressible strip constructed in accordance with claim 13 wherein the vapor impermeable tape comprises an aluminized polymeric film whereby a vapor barrier is maintained and radiant heat loss reduced.

15. A compressible strip for use in conjunction with a movable insulation system adapted for selective insertion into and removal from a window casing, the strip comprising a laminate, the laminate including a pair of compressible elongate foam webs having substantially planar opposed inner faces, an elongate intermediate vapor impermeable membrane, means securing the membrane to each of the opposed faces, the membrane comprising a polymeric film, the strip being adapted for securement around the peripheral edges of a planar rigid foam sheathing which is dimensioned to be received within the window casing and with the membrane lying substantially parallel to the sheathing plane and providing a continuous vapor barrier between an interior space and a window.

16. A compressible strip constructed in accordance with claim 13 wherein the vapor impermeable tape comprises a translucent polymeric film whereby a vapor barrier is maintained and radiant heat loss reduced.

* * * * *